United States Patent [19]

Mattson

[11] 4,371,997

[45] Feb. 8, 1983

[54] ADJUSTABLE FIRMNESS CUSHION WITH MULTIPLE LAYERED FOAM-FILLED COMPARTMENTS

[76] Inventor: Roy D. Mattson, 2194 Deer Pass Trail, White Bear Lake, Minn. 55110

[21] Appl. No.: 181,166

[22] Filed: Aug. 25, 1980

[51] Int. Cl.[3] ..... A47C 27/10; A47C 27/18

[52] U.S. Cl. ..... 5/450; 5/455; 297/DIG. 3

[58] Field of Search ..... 5/449, 450, 451, 452, 5/453, 454, 455, 456, 457, 458, 441; 297/DIG. 3

[56] References Cited

U.S. PATENT DOCUMENTS

| | | | |
|---|---|---|---|
| 2,691,179 | 10/1954 | Kann | 5/455 |
| 2,750,606 | 6/1956 | Freedlander et al. | 5/441 |
| 2,779,034 | 1/1957 | Arpin | 5/450 |
| 2,938,570 | 5/1960 | Fladole | 5/456 |
| 2,997,100 | 8/1961 | Morris | 5/450 |
| 3,608,961 | 9/1971 | Von Heck | 5/450 |
| 3,644,949 | 2/1972 | Diamond | 5/441 |

FOREIGN PATENT DOCUMENTS

| | | | |
|---|---|---|---|
| 2816641 | 10/1978 | Fed. Rep. of Germany | 5/455 |
| 1263418 | 2/1972 | United Kingdom | 5/450 |

*Primary Examiner*—Alexander Grosz

*Attorney, Agent, or Firm*—Jacobson and Johnson

[57] ABSTRACT

Foam plastic pads are contained in separate air-tight compartments with each of the compartments having an air passage which is controlled by a manually operated valve. The person using the cushion first allows air to enter the compartments, then rests on the cushion and allows the air to exhaust until the cushion feels comfortable as it forms to the contour of the person's body and the valve is then closed and the cushion will hold its shape for some time or until the valve is opened.

6 Claims, 1 Drawing Figure

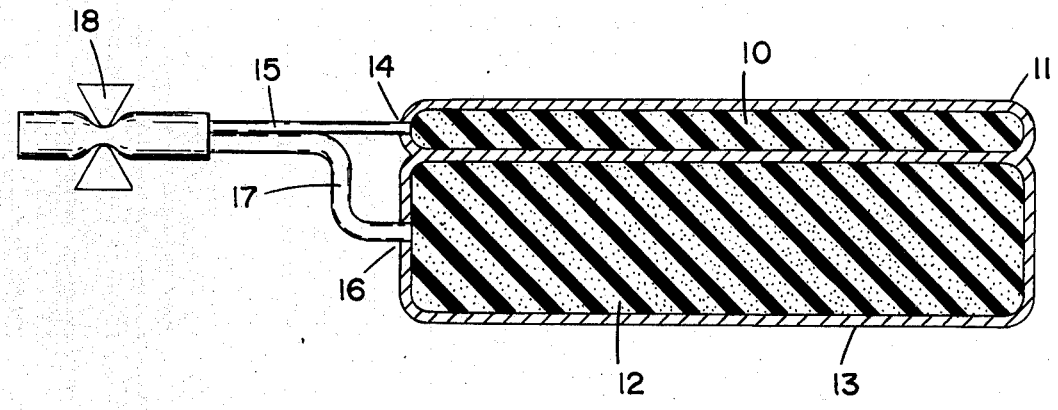
18
15
14
10
11
17
16
12
13

ADJUSTABLE FIRMNESS CUSHION WITH MULTIPLE LAYERED FOAM-FILLED COMPARTMENTS

FIELD OF THE INVENTION

This invention is intended for use as a cushioning device such as a seat cushion or a mattress or anything of a similar nature where the user may be sitting or lying in one spot for relatively long periods of time. It is directed toward providing more comfort than has been possible in the past and is likely to help prevent sores or soreness from developing. It can be used by invalids who are restricted to wheelchairs or beds or it can be used by truck drivers or other persons who have to sit or lie quite still for extended periods of time.

SUMMARY OF THE INVENTION

At least two layers of foamy flexible material are each contained in a separate relatively snug-fitting compartment which is substantially hermetically sealed and the only opening for air to pass into or out of each compartment is controlled by a manually operable valve. One layer of foam is thicker than the other layer. The user sits or lies on the cushion and when his chosen comfort level is reached he closes the valve to prevent any more air from escaping from the foam layers. In this fashion the cushion is then generally shaped to the outline of the part of the body which was in contact with the cushion and retains this comfort level for an extended period of time. From time to time the user can readjust the comfort level by removing himself from the cushion allowing air to enter the chambers and then repositioning himself on the cushion until his selected comfort level is again reached and then closing the valve.

DESCRIPTION OF THE PREFERRED EMBODIMENT

With reference to the single FIGURE in the drawing, a first pad 10 made of flexible urethane foam is enclosed in a first or upper compartment by a surrounding layer 11 of impervious material such as vinyl plastic and a second thicker pad 12 also made of flexible urethane foam is contained in a second or lower compartment by a covering layer 13 of impervious material such as vinyl. The vinyl covers each of the respective pads in a relatively snug fashion and the vinyl is sealed so that the respective pads 10 and 12 are in virtually air-tight compartments. An opening or port 14 is formed through the vinyl layer 11 to provide air flow to and from pad 10 and coupled thereto is a conduit or tube 15. In a similar fashion opening 16 is provided through vinyl sheet 13 for communication with pad 12 and is coupled to tube 17. The only way in which air can pass from and to pads 10 and 12 is through the respective ports 14 and 16 and the tubes 15 and 17. The tubes 15 and 17 are physically joined together, or may be manifolded together, so that a single manually operable valve 18 can be used to open and close both tubes simultaneously.

It has been found preferable that the thicker pad 12 should be about four times the thickness of the thinner pad 10 but the exact ratio does not appear to be critical. The thinner pad 10 is preferably made of urethane foam which has a higher index of firmness than the thicker pad 12. Typically, the thicker pad 12 may be about two inches thick and pad 10 may be about one-half inch thick. The thicker pad may have a density in the order of 1.4 lb/cu. ft. (p.c.f.) and the thinner pad 10 a density in the order of about 1.8 lb/cu. ft. (p.c.f.) Further, the firmness of the foam in the thicker pad might be in the order ot ILD of about 44 lbs. as compared to ILD of about 50 lbs. for the firmness of the foam in the thinner pad 10. The diameter of tube 15 coupled to the thinner pad 10 is preferably about half the diameter of tube 17 which is coupled to the thicker pad 12. The covering forming the respective compartments may be about 0.020 inch plastic vinyl.

In use, valve 18 is open to allow air to enter the compartments and reach and fill the pores of pads 10 and 12. The user then sits, or lies, on the cushion with the air valve open to allow air to exhaust from the pads 10 and 12 until the comfort level he desires is reached. Then the user closes valve 18 to prevent any further air from leaving the pads. The cushion will then retain that shape and level of comfort for an extended period of time. If the user desires to reset the comfort level, he lifts himself off the cushion and opens valve 18 until the cushion has again reached full expansion then again sits on the cushion allowing air to leave through tubes 15 and 17 until he feels comfortable and then closes valve 18. The cushion can be provided with an additional cover, for example one made of fur, if the vinyl plastic is harmful or is uncomfortable for the user. Also, various colors can be used to make the cushion attractive and, of course, removable covers can be used which can be changed for cleaning or for decorative purposes.

It has been found that the foam pads 10 and 12 may be slightly dampened with a saline solution to retain the softness of the foam and help maintain it pliable. It has been found preferable that, in use, the thinner layer be the upper layer of the cushion.

In the event the user is unable to be lifted off the cushion yet the comfort level needs adjustment, it is possible to provide a connection for a source of pressurized air, or some other suitable gas, which can be used to inflate the cushion and after it is inflated the user stops the flow of pressurized air and adjusts the comfort level as desired in the manner described above.

Alternatively, the cushion can be provided with a presure gauge which can be used to visually set the air pressure to a prescribed level and also to check for excessive air leakage out of the cushion.

I claim:

1. Cushion comprising:

at least two layers of flexible urethane foam, each layer substantially hermetically sealed in its own compartment by a surrounding thin sheet of flexible material the foam substantially filling each compartment;

one layer substantially overlaying another;

an air port for each of said compartments;

a tube connected at one end to each port and open to atmosphere at its other end; and a manually operable valve coupled to said tubes for selectively opening or closing off the tubes.

2. The cushion as described in claim 1 wherein one of the layers of foam is substantially thicker than the other layer.

3. The cushion as described in claim 2 wherein the air port opening and the tube for the thicker layer is larger than the air port opening and the tube for the thinner layer.

4. The cushion as described in claim 1 wherein the two tubes are manifolded into a single air line open to atmosphere and the valve is located in said single air line.

5. The cushion as described in claim 1 wherein one of the layers of foam is about four times the thickness of the other layer.

6. The cushion as described in claim 1 wherein the air port opening and the tube to the thicker layer is about twice the diameter of the air port opening and the tube to the other layer.

* * * * *